United States Patent [19]

Brown et al.

[11] 3,973,059

[45] Aug. 3, 1976

[54] METHOD OF MAKING METAL FLOCKED FABRIC

[75] Inventors: Perry H. Brown, Norwell; Maurice H. Tremblay, Westboro; Norman F. Surprenant, Littleton, all of Mass.

[73] Assignee: Brunswick Corporation, Skokie, Ill.

[22] Filed: Aug. 16, 1974

[21] Appl. No.: 498,097

Related U.S. Application Data

[60] Continuation of Ser. No. 262,518, June 13, 1972, abandoned, which is a division of Ser. No. 861,787, Sept., 1969, Pat. No. 3,697,238.

[52] U.S. Cl. ..... 427/180; 427/26; 427/197; 427/202; 427/206; 427/287; 427/376; 428/90; 428/296; 428/457

[51] Int. Cl.[2] ..... B05D 1/12; B05D 1/14; B05D 1/16

[58] Field of Search ..... 117/16, 17, 17.5, 22, 117/25, 31, 227, 235; 161/67; 29/182, 191.2; 51/400; 427/26, 197, 180, 202, 206, 376, 287; 428/90, 296, 457

[56] References Cited

UNITED STATES PATENTS

| | | | |
|---|---|---|---|
| 360,283 | 3/1887 | Edge | 117/9 |
| 1,026,383 | 5/1912 | Coolidge | 29/182 X |
| 2,278,898 | 4/1942 | Schofield | 117/99 |
| 2,304,263 | 12/1948 | Luty | 117/99 |
| 2,392,161 | 1/1946 | Leverenz | 117/31 X |
| 2,691,774 | 10/1954 | DeGier | 117/92 X |
| 2,826,309 | 3/1958 | Forman et al. | 117/22 X |
| 2,901,373 | 8/1959 | Weiss | 117/9 |
| 3,087,233 | 4/1963 | Turnbull | 29/191.2 X |
| 3,087,599 | 4/1963 | Nelson | 15/182 X |
| 3,277,564 | 10/1966 | Webber et al. | 29/419 |
| 3,323,879 | 6/1967 | Kerstetter et al. | 29/182 |
| 3,328,218 | 6/1967 | Noyes | 156/72 X |
| 3,351,439 | 11/1967 | Jost | 29/182 X |
| 3,414,928 | 12/1968 | Lemelson | 161/64 |
| 3,436,245 | 4/1969 | Grundman | 161/64 X |
| 3,469,297 | 9/1969 | Webber | 29/183.5 X |
| 3,505,038 | 4/1970 | Luksch et al. | 29/191 X |
| 3,505,039 | 4/1970 | Roberts et al. | 29/191.6 |
| 3,506,885 | 4/1970 | Roberts et al. | 317/230 |
| 3,660,888 | 5/1972 | Epstein et al. | 117/31 X |

*Primary Examiner*—Ronald H. Smith
*Assistant Examiner*—Shrive P. Beck
*Attorney, Agent, or Firm*—John G. Heimovics; David S. Guttman; William G. Lawler, Jr.

[57] ABSTRACT

A method of making a flocked fabric wherein metal flock fibers are secured to a base. The fibers may be secured as by adhesive, metal fusion bonding, etc. The flock fibers may be metal fusion bonded to each other, may be maintained in spaced relationship, may be provided in tufts, etc.

2 Claims, 11 Drawing Figures

METHOD OF MAKING METAL FLOCKED FABRIC

CROSS REFERENCE TO COPENDING APPLICATION

This is a continuation of application Ser. No. 262,518, filed June 13, 1972, and now abandoned. This is a divisional application of U.S. Ser. No. 861,787 filed Sept. 29, 1969 now U.S. Pat. No. 3,697,238.

BACKGROUND OF THE INVENTION

1. Field of the Invention

This invention relates to forming of fabrics such as textile fabrics and in particular to the forming of metallic fabrics.

2. Description of the Prior Art

The concept of flocking is almost five hundred years old, having originated in wall coverings wherein short fiber lengths were blown onto wet paint to provide a unique appearance. The prior art has developed to a substantial technology wherein many different methods of applying flock fibers to a base have been developed. Such methods include beater bar flocking wherein the base is forcibly struck while the flock material is dropped onto the base. The falling flock fibers attempt to orient themselves somewhat erectly. To provide improved orientation, electrostatic deposition methods have been developed wherein substantial voltages of up to approximately 150,000 v. are applied to not only orient the fibers, but also to provide improved delivery of the fibers onto the base material. In a further known process, the fibers are mechanically installed onto the base by cutting the fibers from a sheet aligned with a guide to form a continuous layer onto the base.

The fibers conventionally comprise man-made and natural textile fibers. Conventionally the fibers are retained on the base by means of a suitable adhesive coating applied onto the base. Adhesives, such as neoprene-based adhesives, solvent-based adhesives, and emulsion-type adhesives, have been utilized for this purpose. The adhesives have been applied by knife cutting, rolling, and screen printing.

Such a flocked material has been used not only for decorative purposes, such as in wall covering material but also in carpeting, apparel including imitation fur apparel, etc., millinery, accessories, decorative ribbons, draperies, upholstery, undergarments, etc.

SUMMARY OF THE INVENTION

The present invention comprehends an improved flocked fabric material wherein the flocked material comprises metallic flock fibers. The metallic fibers may be secured to the base by adhesive means, autogenous, or metal fusion bonding means, etc. The flock fibers may be loosely associated relative to each other on the base material, or may be bonded together as by metal fusion bonding. The base material may comprise metallic material such as random laid web material, woven, knit, etc., wet or dry, carded or air laid, fabric material, etc. The base material may alternatively comprise a collimated hole structure formed of a substantially monolithic body having a plurality of spaced through passages such as disclosed and claimed in Roberts et al co-pending application for U.S. letters patent, Ser. No. 778,679, filed Nov. 25, 1968, now U.S. Pat. No. 3,506,885, issued Apr. 14, 1970. The fibers preferably have a rough, unmachined, unburnished outer surface formed as by multiple end drawing of matrix material with removal of the matrix material either prior to or subsequent to the flocking operation. The flocking may be accomplished with or without electrostatic charging means. The bonding of the fibers may be effected by preliminarily securing them as with adhesive means and subsequently removing the adhesive means. Sacrificial material may be associated with the fibers as desired, such material being removed subsequent to the flocking operation for desired flocking effects.

The metal fibers are preferably relatively small, having a diameter similar to, or smaller than conventional man-made or natural textile fibers. The metal fibers may be blended with nonmetal fibers, as desired. The fibers may comprise an electrically nonconductive core having a conductive coating.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
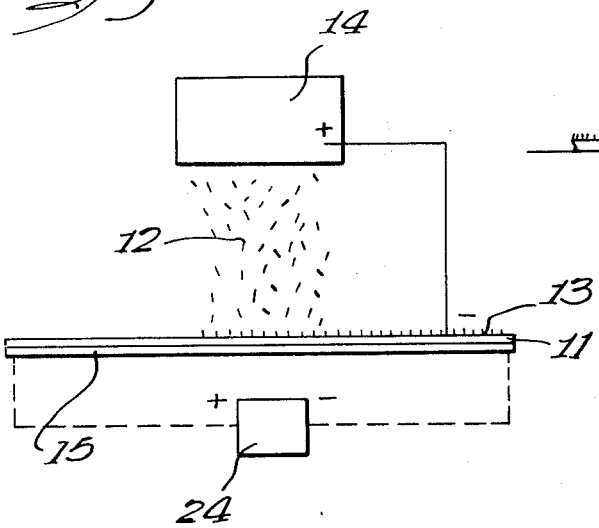
FIG. 1 is a schematic view of a flocking apparatus illustrating one method of forming the flocked fabric of the present invention.

In the exemplary embodiments of the invention as disclosed in the drawing, a flocked fabric, generally designated 10 is shown to comprise a base portion 11 and flock fibers 12 secured to the base to extend generally upwardly from the upper surface 13 of the base in a conventional flock arrangement. Herein, the flock fibers 12 are metallic, being formed of small diameter metal fibers, such as BRUNSMET fibers produced by Brunswick Corporation. Such fibers are shown and described in Webber and Wilson U.S. Pat. No. 3,277,564. Briefly, such fibers are formed by a constriction process wherein a plurality of elongated metal elements are disposed in a matrix to define a composite which is subsequently constricted by suitable constricting steps, including cold drawing steps, to have in a final drawn condition preselected extremely small diameter.

The fibers are then released from the matrix material as by chemical dissolution of the matrix material, leaving the resultant fibers having rough, unmachined, unburnished outer surfaces. The fibers conventionally are formed in substantially continuous lengths and may be formed into suitable short lengths by suitable methods such as by cutting, chopping, tensile breaking, etc.

Figure 2:
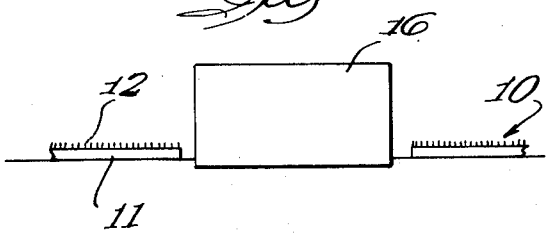
FIG. 2 is a schematic elevation illustrating a sintering step for metal fusion bonding the fibers.
Figure 3:
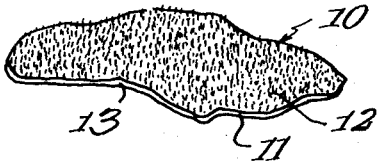
FIG. 3 is a fragmentary perspective view of a flocked fabric embodying the invention.

As shown in FIG. 1, the short length fibers 12 are delivered onto the base material 11 in a conventional flocking operation wherein the fibers are dropped onto the upper surface 13. To facilitate orientation of the fibers perpendicular to the upper surface 13, conventional electrostatic apparatus 14 may be provided to apply suitable electrostatic potential between the fibers and the base material where the base material is metallic, or to a subjacent table 15 where the base material is nonmetallic. Illustratively, potential of up to 150,000 v. may be utilized for this purpose. As shown in FIG. 1, the metal flock fibers thusly orient themselves in an upright position generally perpendicularly to the upper surface 13. To provide an improved flocked fabric 10, it is desirable that the fibers be relatively uniform in length and relatively straight. The fibers preferably should be without hooked ends such as may be formed by cutting operations.

Where the base material comprises or includes metallic material, such as metal fibers, the flock fibers may be bonded thereto as by autogenous or metal fusion bonding. Thus, as illustrated in FIG. 2, the base 11 with the fiber 12 thereon may be sintered in a conventional sintering furnace 16 to form bonded flocked fabric 10.

Figure 4:
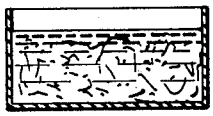
FIG. 4 is a schematic vertical section illustrating one method of applying adhesive material to the metal fibers.

To facilitate the fusion bonding, the fibers may be precoated with suitable adhesive material either by conventional spraying operations or by batch mixing as shown in FIG. 4. Suitable materials for such bonding may comprise collodion, camphor and ether, conventional adhesive cements, settable plastics, etc. The adhesive material may be removed as by a burning off operation as a result of the high temperatures utilized in the fusion bonding operation. The adhesive material may be applied in the conventional manner onto the upper surface 13 of the base material 11 prior to the flocking operation illustrated in FIG. 1.

The flocking material delivered from the electrostatically charged supply 14 may comprise a mixture of fibers such as fibers of different metals. Thus, in a final forming step, fibers of one or more of the metals may be removed as by chemical dissolution leaving a relatively spaced flocked surface.

Figure 6:
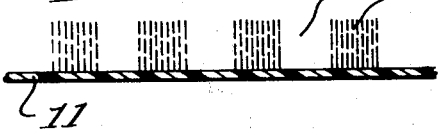
FIG. 6 is a fragmentary vertical section of the flocked material during a first step in the flocking operation.
Figure 5:
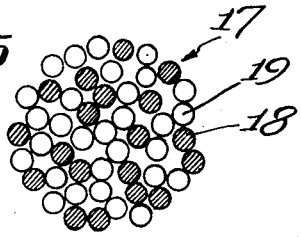
FIG. 5 is an enlarged cross-section of a composite having different types of fibers disposed therein suitable for use in the flocking operation.
Figure 7:
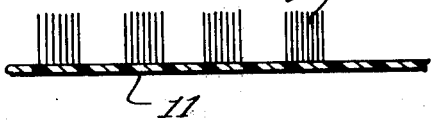
FIG. 7 is a view similar to that of FIG. 6 showing the flocked fabric subsequent to the removal of a sacrificial portion of the flock material.

As shown in FIG. 5, the flocking fibers may comprise composites 17 made up of such different metallic elements 18 and 19. A mixture of short lengths of such composites 17 may be mixed with short lengths of solid fibers, such as fibers 20, so that a distribution of the composite fibers 19 and fibers 20 will be provided on the base material 11 as shown in FIG. 6. Subsequent suitable removal of the fibers 20 and the removable fibers of the composite 17 provides a relatively widely spaced group of flocked tufts 21 as shown in FIG. 7 as the flocked surface. Thus, the fibers 19 may be extremely small in diameter while yet permitting facilitated flocking while maintained in the composite configuration. As discussed above, the fibers 19 may be distributed in a body of dissimilar metal fibers, as desired.

Figure 8:
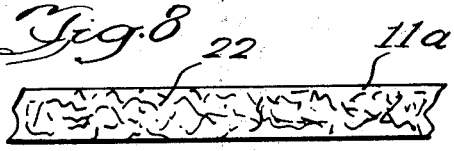
FIG. 8 is a fragmentary enlarged vertical section of a random laid web suitable for use in the flocked fabric.
Figure 11:
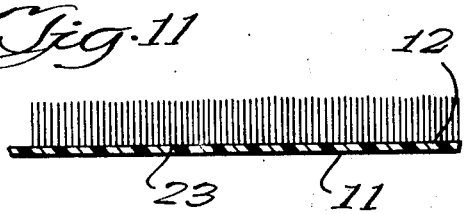
FIG. 11 is a fragmentary cross-section of a flocked fabric embodying the invention wherein the flock fibers are maintained unbonded to each other.

As shown in FIG. 8, the base 11 may comprise a random laid web 11*a*. The webbed fibers 22 may comprise metal fibers, nonmetal fibers, or a mixture of metal and nonmetal fibers, as desired. The web may be formed by a conventional air laying process, as desired. The web may be compacted or uncompacted depending on the desired web characteristics. Further the web may be presintered to provide prebonding of the fibers thereof to each other, or may comprise loosely associated fibers, as desired.

Figure 9:
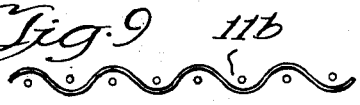
FIG. 9 is a fragmentary enlarged vertical section of a woven form of base material suitable for use in the flocked fabric.

Alternatively, base 11 may comprise a woven or knitted textile fabric, such as fabric 11*b* shown in FIG. 9. The invention comprehends the provision of any suitable base material capable of carrying the metallic flock fibers and the illustrated bases are exemplary only.

The invention further comprehends the securing of the metallic flock fibers to the base 11 while maintaining the fibers in free association relative to each other. Thus, the metal fibers may be bonded to the upper surface 13 of base 11 as by application of a suitable bonding layer 23 which may comprise suitable adhesive, setting material, etc.

Figure 10:
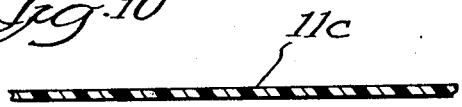
FIG. 10 is a fragmentary enlarged vertical section of a nonporous metal base suitable for use in the flocked fabric.

As shown in FIG. 10, the base may comprise a suitable sheet 11*c* and may be porous or nonporous as desired. Further, the sheet 11*c* may be formed of metal or other suitable material as desired.

One desirable application of such a flocked fabric is in connection with electrostatic deposition. Thus, by utilization of the metallic flock fibers, static electricity may be dissipated in the fabric. The flocked fibers may comprise a suitable blend of conductive and nonconductive fibers for providing the electrostatic dissipation characteristics as desired. If desired, the nonconductive portion of the blend may be removed. To provide enhanced dissipation where the fibers are secured to the base by bonding material rather than by metal fusion bonds, the bonding material may be made electrostatically conductive as by being provided with a distribution of electrically conductive particles illustratively formed of metal, graphite, etc. The flocked fabric may further provide for electrical conduction as well as static dissipation by providing the metal portion thereof so as to have electrical contact between the respective fibers sufficient to carry the desired current. The electrical conduction may be provided in the flock fiber portion 12 and/or the base portion 11 as desired.

Illustratively, the adhesive may comprise a metal loaded epoxy resin.

As further shown in FIG. 1, the flocking operation may include concurrently a metal fusion bonding operation by suitably heating the base where the base is partially or completely metallic. Thus, as the fibers fall onto the surface substantially immediate fusion bonding may be effected. In the illustrative embodiment, the base 11 is heated by a suitable power supply 24 providing an electric current through the metallic base suitable to heat it to suitable fusion bonding temperatures. As will be obvious to those skilled in the art, other methods of heating the base material to such temperature may similarly be employed within the scope of the invention.

The application of the flocked material to the base surface 13 may be effected to define preselected patterns, etc. by suitably screening the surface, applying bonding means to the preselected portions only, and by other conventional pattern forming methods. The metal fibers may be formed of any suitable material and illustratively, may comprise stainless steel, nickel, aluminum, and other suitable metals correlated for the particular purpose for which the fabric is intended. The fibers preferably have a diameter corresponding to conventional textile fiber diameters, or smaller, and illustratively, may have a diameter of under 25 microns and as small as submicron sizes. The fibers may have a suitable length, such as from approximately 1 inch down to one-half mil or smaller. As discussed above, different metals may be mixed in the flock material so as to provide desired blended flocking.

The flock fibers 12 may within the scope of the invention comprise magnetizable metal fibers, such as ferrous metal fibers. Illustratively, it has been found that fibers formed of material such as stainless steel may have a suitable magnetizable characteristics in the small fiber sizes discussed above and thus, the flock fibers 12 may be suitably formed of stainless steel. By use of such magnetizable fiber materials, the flocking of the fibers 12 onto the base portion 11 may be effected by magnetic flocking techniques, thus eliminating electrostatic charging of the flocking materials as discussed above.

Thus, flocked fabric 10 comprises an improved flocked material which is extremely simple and economical of manufacture while yet providing a highly desirable improved metal surfaced material. As discussed, the flocked fabric may have electrostatic deposition qualities as desired which may substantially enhance the use of the material in many applications.

The foregoing disclosure of specific embodiments is illustrative of the broad inventive concepts comprehended by the invention.

We claim:

1. A method of forming a flocked metal textile fabric comprising the steps of:

a. providing a porous textile fabric base made from textile metal-forming filaments:

b. flocking composite metal fibers on said base, each composite fiber comprising a plurality of textile metal fibers having rough, unmachined, unburnished outer surfaces, the textile fibers being disposed in a metal matrix material;

c. autogeneously bonding the composite fibers to said base; and d. removing the matrix material.

2. The method of claim 1 wherein the composite comprises nickel textile metal fibers in an aluminum matrix material.

* * * * *